US007517623B2

(12) United States Patent
Wu et al.

(10) Patent No.: US 7,517,623 B2
(45) Date of Patent: Apr. 14, 2009

(54) IMAGING MEMBER HAVING ANTISTATIC ANTICURL BACK COATING

(75) Inventors: Jin Wu, Webster, NY (US); Kathleen M. Carmichael, Williamson, NY (US); Edward F. Grabowski, Webster, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 339 days.

(21) Appl. No.: 11/491,762

(22) Filed: Jul. 24, 2006

(65) Prior Publication Data

US 2008/0019734 A1 Jan. 24, 2008

(51) Int. Cl.
*G03G 5/14* (2006.01)

(52) U.S. Cl. ..... 430/56; 430/58.05; 399/159

(58) Field of Classification Search ..... 430/56, 430/58.05; 399/159
See application file for complete search history.

(56) References Cited

U.S. PATENT DOCUMENTS

| | | | | |
|---|---|---|---|---|
| 3,121,006 | A | | 2/1964 | Middleton et al. |
| 4,298,697 | A | | 11/1981 | Baczek et al. |
| 4,338,390 | A | | 7/1982 | Lu |
| 4,464,450 | A | | 8/1984 | Teuscher |
| 4,560,635 | A | | 12/1985 | Hoffend et al. |
| 4,654,284 | A | | 3/1987 | Yu et al. |
| 4,921,773 | A | | 5/1990 | Melnyk et al. |
| 5,021,309 | A | * | 6/1991 | Yu ..... 430/59.6 |
| 5,069,993 | A | | 12/1991 | Robinette et al. |
| 5,919,590 | A | * | 7/1999 | Yu et al. ..... 358/1.15 |
| 6,071,662 | A | * | 6/2000 | Carmichael et al. ..... 430/69 |
| 6,156,468 | A | | 12/2000 | Wehelie et al. |
| 6,177,219 | B1 | | 1/2001 | Yuh et al. |
| 6,255,027 | B1 | | 7/2001 | Wehelie et al. |
| 6,528,226 | B1 | | 3/2003 | Yu et al. |

OTHER PUBLICATIONS

Diamond, "Handbook of Imaging Materials" Marcel Dekker, NY, NY 1991. p. 160-162.*

* cited by examiner

*Primary Examiner*—Christopher RoDee
*Assistant Examiner*—Peter L Vajda
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to the incorporation of polyol esters and/or amides in the anticurl back coating to reduce or eliminate static charge buildup in the imaging member and to improve image quality.

18 Claims, No Drawings

IMAGING MEMBER HAVING ANTISTATIC ANTICURL BACK COATING

CROSS REFERENCE TO RELATED APPLICATIONS

Reference is made to copending, commonly assigned U.S. patent application Ser. No. 11/491,813 to Wu et al., filed Jul. 24, 2006, entitled, "Imaging Member Having Antistatic Anticurl Back Coating", copending, commonly assigned U.S. patent application Ser. No. 11/491,692 to Wu et al., filed Jul. 24, 2006, entitled, "Imaging Member Having Antistatic Anticurl Back Coating", copending, commonly assigned U.S. patent application Ser. No. 11/491,691 to Wu et al., filed Jul. 24, 2006, entitled, "Imaging Member Having Antistatic Anticurl Back Coating", copending, commonly assigned U.S. patent application Ser. No. 11/491,716 to Wu et al., filed Jul. 24, 2006, entitled, "Imaging Member Having Antistatic Anticurl Back Coating", copending, commonly assigned U.S. patent application Ser. No. 11/491,651 to Wu et al., filed Jul. 24, 2006, entitled, "Imaging Member Having Antistatic Anticurl Back Coating", copending, commonly assigned U.S. patent application Ser. No. 11/491,764 to Wu et al., filed Jul. 24, 2006, entitled, "Imaging Member Having Antistatic Anticurl Back Coating", and copending, commonly assigned U.S. patent application Ser. No. 11/492,030 to Wu et al., filed Jul. 24, 2006, entitled, "Imaging Member Having Antistatic Anticurl Back Coating".

BACKGROUND

The present disclosure relates generally to imaging members, such as layered photoreceptor devices, and processes for making and using the same. The imaging members can be used in electrophotographic, electrostatographic, xerographic and like devices, including printers, copiers, scanners, facsimiles, and including digital, image-on-image, and like devices. More particularly, the embodiments pertain to an imaging member or a photoreceptor that incorporates specific materials, namely polyol esters/amides, into the anticurl back coating (ACBC) layer.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors have at least two layers, and may include a substrate, a conductive layer, an optional charge blocking layer, an optional adhesive layer, a photogenerating layer (sometimes referred to as a "charge generation layer," "charge generating layer," or "charge generator layer"), at least one charge transport layer, an optional overcoating layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements, including narrow operating limits, on the imaging members.

In multilayered imaging members, the CTL is usually the last layer to be coated and is applied by solution coating then followed by drying the wet applied coating at elevated temperatures of about 120° C., and finally cooling it down to room ambient temperature of about 25° C. When a production web stock of several thousand feet of coated multilayered photoreceptor material is obtained after finishing application of the CTL coating through drying and cooling processes, exhibition of spontaneous upward curling of the multilayered photoreceptor is observed. This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL does therefore have a larger dimensional shrinkage than that of the substrate support as the imaging member web stock cools down to ambient room temperature. The exhibition of imaging member curling after completion of CTL coating is due to the consequence of the heating/drying/cooling processing.

To offset the curling, an anticurl back coating is then applied to the backside of the flexible substrate support, opposite to the side having the charge transport layer, and render the imaging member web stock with desired flatness. Curling of a photoreceptor web is undesirable because it hinders fabrication of the web into cut sheets and subsequent welding into a belt. An anticurl back coating having a counter curling effect equal to and in the opposite direction to the applied layers is applied to the reverse side of the active imaging member to eliminate the overall curl of the coated device by offsetting the curl effect which is arisen from the mismatch of the thermal contraction coefficient between the substrate and the CTL, resulting in greater CTL dimensional shrinkage than that of the substrate.

Although the anticurl back coating is needed to counteract and balance the curl so as to allow the imaging member web to lay flat, nonetheless, common formulations used for anticurl back coatings have often been found to provide unsatisfying dynamic imaging member belt performance under a normal machine functioning condition; for example, exhibition of excessive anticurl back coating wear and its propensity to cause electrostatic charge buildup are the frequently seen problems that prematurely cut short the service life of the photoreceptor belt and require its frequent costly replacement in the field.

Moreover, high surface contact friction of the anticurl back coating against all these machine subsystems is further been found to cause the development of electrostatic charge buildup problem. In many machines, the electrostatic charge builds up due to high contact friction between the anticurl back coating and the backer bars is seen to significantly increase the frictional force to the point that it requires higher torque from the driving motor to pull the belt for effective cycling motion. In full color electrophotographic machines, using a 10-pitch photoreceptor belt, this electrostatic charge build-up can be extremely high due to large number of backer bars used in the machine.

In an effort to resolve the problems associated with the anticurl back coating, one known wear resistance anticurl back coating formulated for use in the printing apparatuses includes organic particles reinforcement such as the utilization of polytetrafluoroethylene (PTFE) dispersion in the anticurl back coating polymer binder. PTFE particles are commonly incorporated to reduce the friction between the anticurl back coating of the belt and the backer bars. The benefit of using this formulation is, however, outweighed by the instability of the PTFE particle dispersion in the anticurl back coating solution. PTFE, being two times heavier than the coating solution, forms an unstable dispersion in a polymer coating solution, commonly a bisphenol A polycarbonate polymer solution, and tends to settle with particles flocculate themselves into big agglomerates in the mix tanks if not continuously stirred. The difficulty of achieving good PTFE dispersion in the coating solution poses a problem, because it can result in an anticurl back coating with insufficient and variable or inhomogeneous PTFE dispersion along the length of the coated web, and thus, inadequate reduction of friction over the backer bars in the copiers or printers. This causes significant complications in the larger copiers or printers, which often include so many backer bars that the high friction increases the torque needed to drive the belt. Consequently, two driving rollers are included and synchronized to prevent any registration error to occur. The additional components result in high costs for producing and using these larger printing apparatuses. Thus, if the friction could be reduced, the apparatus design in these larger printing apparatuses could be simplified with less components, resulting in significant cost savings.

Some anticurl back coating formulations are disclosed in U.S. Pat. Nos. 5,069,993, 5,021,309, 5,919,590, 4,654,284 and 6,528,226. However, while these formulations serve their intended purposes, further improvement on those formulations are desirable and needed. More particularly, there is a need, which is addressed herein, for a way to create an anticurl back coating formulation that has intrinsic properties to minimize or eliminate charge accumulation in photoreceptors without sacrificing the other electrical properties.

The term "electrostatographic" is generally used interchangeably with the term "electrophotographic." In addition, the terms "charge blocking layer" and "blocking layer" are generally used interchangeably with the phrase "undercoat layer."

SUMMARY

According to embodiments illustrated herein, there is provided a way in which print quality is improved, for example, static electricity generally due to the triboelectric effect is reduced or substantially eliminated in imaging systems.

According to embodiments illustrated herein, there is also provided a way in which print quality is improved, for example, the wear resistance is improved and the friction is reduced between the anticurl back coating of the belt and the backer bars in imaging systems. In one embodiment, there is provided an imaging member comprising a substrate, a charge generating layer disposed on the substrate, at least one charge transport layer disposed on the charge generating layer, and an anticurl back coating disposed on the substrate on a side opposite to the charge transport layer, the anticurl back coating comprising a polyol ester or polyol amide.

An imaging member, comprising a substrate, a charge generating layer disposed on the substrate, at least one charge transport layer disposed on the charge generating layer, and an anticurl back coating disposed on the substrate on a side opposite to the charge transport layer, the anticurl back coating comprising a polyol ester or a polyol amide, wherein the polyol ester is generated from the reaction of a polyol containing at least one hydroxyl group and a monobasic acid or an acid halide, and wherein the polyol amide is generated from the reaction of a polyamine containing at least one amine group and a monobasic acid or an acid halide.

There is also provided an image forming apparatus for forming images on a recording medium comprising an imaging member having a charge retentive-surface for receiving an electrostatic latent image thereon, a development component for applying a developer material to the charge-retentive surface to develop the electrostatic latent image to form a developed image on the charge-retentive surface, a transfer component for transferring the developed image from the charge-retentive surface to a copy substrate, and a fusing component for fusing the developed image to the copy substrate. In such embodiments, the imaging member of the image forming apparatus comprises a substrate, a charge generating layer disposed on the substrate, at least one charge transport layer disposed on the charge generating layer, and an anticurl back coating disposed on the substrate on a side opposite to the charge transport layer, the anticurl back coating comprising a polyol ester or polyol amide.

DETAILED DESCRIPTION

It is understood that other embodiments may be utilized and structural and operational changes may be made without departure from the scope of the embodiments disclosed herein.

The embodiments relate to an imaging member or photoreceptor that incorporates a polyol ester or polyol amide to the formulation of an anticurl back coating that helps reduce, or substantially eliminates, electrostatic charge buildup caused by friction with the backer plates and rollers.

The embodiments relate to an imaging member or photoreceptor that incorporates a polyol ester or polyol amide to the formulation of an anticurl back coating that helps reduce friction and improves wear resistance caused by contact with the backer plates and rollers.

According to embodiments herein, an electrophotographic imaging member is provided, which generally comprises at least a substrate layer, an imaging layer disposed on the substrate, and an overcoat layer disposed on the imaging layer. The imaging member may include, as imaging layers, a charge transport layer or both a charge transport layer and a charge generation layer. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

In a typical electrostatographic reproducing apparatus such as electrophotographic imaging system using a photoreceptor, a light image of an original to be copied is recorded in the form of an electrostatic latent image upon a imaging member and the latent image is subsequently rendered visible by the application of a developer mixture. The developer, having toner particles contained therein, is brought into contact with the electrostatic latent image to develop the image on an electrostatographic imaging member which has a charge-retentive surface. The developed toner image can then be transferred to a copy substrate, such as paper, that receives the image via a transfer member.

Alternatively, the developed image can be transferred to another intermediate transfer device, such as a belt or a drum, via the transfer member. The image can then be transferred to the paper by another transfer member. The toner particles may be transfixed or fused by heat and/or pressure to the paper. The final receiving medium is not limited to paper. It can be various substrates such as cloth, conducting or non-conducting sheets of polymer or metals. It can be in various forms, sheets or curved surfaces. After the toner has been transferred to the imaging member, it can then be transfixed by high pressure rollers or fusing component under heat and/or pressure.

Illustrated herein are embodiments of an imaging member comprising a substrate, a charge generating layer disposed on the substrate, at least one charge transport layer disposed on the charge generating layer, and an anticurl back coating disposed on the substrate on a side opposite to the charge transport layer, the anticurl back coating comprising a polyol ester or polyol amide. The polyol ester or polyol amide is incorporated into the anticurl back coating to reduce electrostatic charge buildup in the imaging member. Polyol esters/amides make the anticurl back coating surface or the entire layer itself slightly conductive.

In embodiments, polyol esters such as glycerol fatty acid esters can, for example, be referred to as an ester generated from the reaction of a polyol containing one or more hydroxyl groups in one molecule with one or plural monobasic acids or acid halides. Suitable polyol examples may be selected from saturated and unsaturated straight and branched chain linear aliphatic; saturated and unsaturated cyclic aliphatics, including heterocyclic aliphatic; or mononuclear or polynuclear aromatics, including heterocyclic aromatics alcohols. Polyols with one hydroxyl group include methanol, ethanol, 1-propanol, 2-propanol, 1-butanol, 2-butanol, ethoxy ethanol, propoxy ethanol, butoxy ethanol, ethoxy propanol, propoxy propanol, butoxy propanol, ethoxy butanol, propoxy butanol, and butoxy butanol. Polyols with two or more hydroxyl groups include hindered alcohols with for example, from about 5 to about 30 carbon atoms, for example, polyethylene glycol, polypropylene glycol, polytetramethylene glycol, neopentyl glycol, 2,2-diethyl propane-1,3-diol, 2,2-dibutyl propane-1,3-diol, 2-methyl-2-propyl propane-1,3-diol, 2-ethyl-2-butyl propane-1,3-diol, trimethylol ethane, trimethylol propane, ditrimethylol propane, tritrimethylol propane, tetratrimethylol propane, pentaerythritol, dipentaerythritol, tripentaerythritol, tetrapentaerythritol, and pentapentaerythritol, or mixtures thereof. Specific hindered alcohols are those with from about 5 to about 10 carbon atoms such as trimethylol propane, ditrimethylol propane, pentaerythritol, dipentaerythritol, and tripentaerythritol. Polyols also include carbohydrate molecules, such as monosaccharides including, for example, mannose, galactose, arabinose, xylose, ribose, apiose, rhamnose, psicose, fructose, sorbose, tagitose, ribulose, xylulose, and erythrulose. Oligosaccharides include, for example, maltose, kojibiose, nigerose, cellobiose, lactose, melibiose, gentiobiose, turanose, rutinose, trehalose, sucrose and raffinose. Polysaccharides include, for example, amylose, glycogen, cellulose, chitin, inulin, agarose, zylans, mannan and galactans. Although perhaps sugar alcohols may not be considered carbohydrates, the naturally occurring sugar alcohols are very closely related to carbohydrates. Examples of sugar alcohols are sorbitol, mannitol and galactitol.

Examples of the monobasic acids include saturated aliphatic carboxylic acids, such as acetic acid, propionic acid, butyric acid, isobutyric acid, valeric acid, pivalic acid, heptanoic acid, octanoic acid, nonanoic acid, decanoic acid, lauric acid, myristic acid and palmitic acid; unsaturated aliphatic carboxylic acids, such as stearic acid, acrylic acid, propionic acid, crotonic acid and oleic acid; and cyclic carboxylic acids, such as benzoic acid, toluic acid, napthoic acid, cinnamic acid, cyclohexanecarboxylic acid, nicotinic acid, isonicotinic acid, 2-furoic acid, 1-pyrrolecarboxylic acid, monoethyl malonate and ethyl hydorgenphthalate. Suitable saturated fatty acids include, for example, capric, lauric, palmitic, stearic, behenic, isomyristic, isomargaric, myristic, caprylic, and anteisoarachadic. Suitable preferred unsaturated fatty acids include, for example, maleic, linoleic, licanic, oleic, linolenic, and erydiogenic acids. Mixtures of fatty acids derived from soybean oil, palm oil, coconut oil, cottonseed and fatty hydrogenated rapeseed oil can also be selected. Examples of acid halides, such as acid chlorides, include the chlorides of the monobasic acids.

Specific examples of polyol esters are neopentyl glycol as NPG, trimethylol propane as TMP, ditrimethylol propane as DTMP, pentaerythritol as PE, dipentaerythritol as DPE, and tripentaerythritol as TPE). In embodiments there can be selected NPG-di(n-butanoate), NPG-di(2-methylpropanoate), NPG-di(n-pentanoate), NPG-di(2-methylbutanoate), NPG-di(n-hexanoate), NPG-di(2-ethylbutanoate), NPG-di(3-ethylbutanoate), NPG-di(n-heptanoate), NPG-di (2-ethylpentanoate), NPG-di(n-octanoate), NPG-di(2-ethylhexanoate), NPG-di(n-nonanate), NPG-di(isononanate), NPG-di(n-decanoate), NPG-di(mixed(n-hexanoate, n-butanoate)), NPG-di(mixed(n-hexanoate, n-pentanoate)), NP di(mixed(n-butanoate, n-heptanoate)), TMP-tri(n-butanoate), TMP-tri(2-methylpropanoate), TMP-tri(n-pentanoate), TMP-tri(2-methylbutanoate), TMP-tri(n-hexanoate), TMP-tri(3-ethylbutanoate), TMP-tri(n-heptanoate), TMP-tri(2-ethylpentanoate), TMP-tri(n-octanoate), TMP-tri (2-ethylhexanoate), TMP-tri(n-nonanate), TMP-tri (isononanate), TMP-tri(n-decanoate), TMP-tri(isodecanoate), TMP-tri(mixed(n-butanoate, n-hexanoate)), DTMP-tetra(n-butanoate), DTMP-tetra(2-methylpropanoate), DTMP-tetra(n-pentanoate), DTMP-tetra(2-methylbutanoate), DTMP-tetra(n-hexanoate), DTMP-tetra(3-ethylbutanoate), DTMP-tetra(n-heptanoate), DTMP-tetra(2-ethylhexanoate), DTMP-tetra(n-octanoate), DTMP-tetra(2-ethylhexanoate), DTMP-tetra(n-nonanate), DTMP-tetra (isononanate), DTMP-tetra(n-decanoate), DTMP-tetra (isodecanoate), DTMP-tetra[mixed(n-butanoate, n-hexanoate)], DTMP-tetra[mixed(n-pentanoate, isohexanoate)], PE-tetra(n-butanoate), PE-tetra(2-methylpropanoate), PE-tetra(n-pentanoate), PE-tetra(2-methylbutanoate), PE-tetra(2,2-dimethylpropanoate), PE-tetra(n-hexanoate), PE-tetra(2-ethylbutanoate), PE-tetra(2,2-dimethylbutanoate), PE-tetra(n-heptanoate), PE-tetra(2-ethylpentanoate), PE-tetra(n-octanoate), PE-tetra(2-ethylhexanoate), PE-tetra(n-nonanate), PE-tetra (isononanate), PE-tetra(n-decanoate), PE-tetra (isodecanoate), PE-tetra(n-decanoate), PE-tetra (isodecanoate), PE-tetra[mixed(n-pentanoate, isopentanoate, n-hexanoate, n-butanoate)], PE-tetra[mixed(n-pentanoate, isopentanoate, n-heptanoate, n-nonanate)], DPE-hexa(n-butanoate), DPE-hexa(2-methylpropanoate), DPE-hexa(n-pentanoate), DPE-hexa(2-methylbutanoate), DPE-hexa(3-methylbutanoate), DPE-hexa(2,2-dimethylpropanoate), DPE-hexa(n-hexanoate), DPE-hexa(2-ethylbutanoate), DPE-hexa (2,2-dimethylbutanoate), DPE-hexa(n-heptanoate), DPE-hexa(2-ethylpentanoate), DPE-hexa(n-octanoate), DPE-hexa(2-ethylhexanoate), DPE-hexa(n-nonanate), DPE-hexa (isononanate), DPE-hexa(n-decanoate), DPE-hexa[mixed(n-pentanoate, isopentanoate, n-heptanoate, n-nonanate)], TPE-octa(n-butanoate), TPE-octa(2-methylpropanoate), TPE-octa(n-pentanoate), TPE-octa(2-methylbutanoate), TPE-octa (2,2-dimethylpropanoate), TPE-octa(n-hexanoate), TPE-octa(2-ethylbutanoate), TPE-octa(n-octanoate), TPE-tetra(2-ethylhexanoate), TPE-octa(n-nonanate), TPE-octa (isononanate), TPE-octa(n-decanoate), TPE-octa[mixed(n-pentanoate, isopentanoate, hexanoate, n-butanoate)], TPE-octa[mixed(isopentanoate, n-hexanoate)], TPE-octa[mixed (n-pentanoate, isopentanoate, n-heptanoate, n-nonanate)] esters of PE, and a mixture containing linear and branched aliphatic acids of, for example, from about 4 to about 10 carbon atoms. Examples of polyol esters also include a neopentyl glycol caprylate caprate mixed ester, a trimethylolpropane valerate heptanoate mixed ester, a trimethylolpropane decanoate octanoate mixed ester, trimethylolpropane nanoate, and a pentaerythritol heptanoate caprate mixed ester. Specifically, in embodiments a polyol ester with about than 4 or less, including no hydroxyl groups can be selected.

Moreover, polyol esters, and/or dibasic acid esters can be incorporated into top layer of the imaging member. Dibasic acid esters include an adipate, azelate, sebacate, 1,9-nonamethylene dicarboxylic acid ester and so on. A complex ester can also be selected. As an alcohol for the dibasic acid ester, a linear or branched, a mono- or polyhydric aliphatic alcohol with, for example, from about 4 to about 20, or from about 8 to about 14 carbon atoms can be utilized. Examples of dibasic acid esters include dioctyl adipate, dioctyl sebacate, diisodecyl adipate, and didecyl adipate. As the organic ester, a polyol ester is selected.

In various embodiments, examples of polyol esters include ZELEC™ 887 (trimethylpropane tricaprylate), ZELEC™ 874 (pentaerythrityl tetracaprylate), STEPAN™ BES (butoxy ethyl stearate), STEPAN™ PEG 400 DO (polyethylene glycol dioleate), all available from STEPAN Company, Northfield, Ill.; HOSTASTAT™ FE20liq (glycerol fatty acid ester), available from Clariant Corporation, Charlotte, N.C.

In embodiments, polyol amides such as glycerol fatty acid amides can, for example, be referred to as an amide generated from the reaction of a polyamine containing one or more amine groups in one molecule with one or plural monobasic acids or acid halides. Examples of polyol amides include NINOL® 201 (produced by condensing one mole of oleic acid with two moles of diethanolamine), C-5 (formerly AMIDOX® C-5, polyethylene glycol cocamide), all available from STEPAN Company, Northfield, Ill.

In embodiments, polyol ester or polyol amide, like the examples named above, are incorporated into conventional photoreceptor surface layers, namely, the anticurl back coating. The coating formulation may, but need not, include PTFE, silica or other like conventional particles used to improve the mechanical properties of the layer. The polyol ester or polyol amide is physically mixed or dispersed into the anticurl back coating solutions or dispersions used to form the eventual anticurl back coating layer in the imaging member.

The polyol ester or polyol amide is generally present in the anticurl back coating at a weight concentration of from about 0.1 percent to about 50 percent, from about 5 percent to about 40 percent, and from about 10 percent to about 30 percent by weight of the total weight of the anticurl back coating.

In various embodiments, the anticurl back coating has a thickness of from about 1 to about 100, or from about 5 to about 50, or from about 10 to about 30 microns.

In embodiments, the polyol ester or polyol amide is physically mixed or dispersed into the anticurl back coating formulation. Some methods that can be used to incorporate a polyol ester or polyol amide into a formulation to form an anticurl back coating include the following: (1) simple mixing of a polyol ester or polyol amide, with an anticurl back coating formulation, with the formulation being previously dispersed before adding the polyol ester or polyol amide (2) milling the polyol ester or polyol amide with the anticurl back coating formulation.

After forming the dispersion for the anticurl back coating, the dispersion is coated on the imaging member substrate. The coating having the added polyol ester or polyol amide is applied onto the substrate and subsequently dried to form the anticurl back coating layer. The anticurl back coating may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the anticurl back coating.

Illustrative examples of substrate layers selected for the imaging members of the present invention may be opaque or substantially transparent, and may comprise any suitable material having the requisite mechanical properties. Thus, the substrate may comprise a layer of insulating material including inorganic or organic polymeric materials, such as MYLAR a commercially available polymer, MYLAR-containing titanium, a layer of an organic or inorganic material having a semiconductive surface layer, such as indium tin oxide, or aluminum arranged thereon, or a conductive material inclusive of aluminum, aluminized polyethylene terephthalate, titanized polyethylene chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. The anticurl back coating is applied to the back of the substrate. Moreover, the substrate may contain thereover an undercoat layer in some embodiments, including known undercoat layers, such as suitable phenolic resins, phenolic compounds, mixtures of phenolic resins and phenolic compounds, titanium oxide, silicon oxide mixtures like $TiO_2/SiO_2$.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

In embodiments, the undercoat layer may also contain a binder component. Examples of the binder component include, but are not limited to, polyamides, vinyl chlorides, vinyl acetates, phenolic resins, polyurethanes, aminoplasts, melamine resins, benzoguanamine resins, polyimides, polyethylenes, polypropylenes, polycarbonates, polystyrenes, acrylics, styrene acrylic copolymers, methacrylics, vinylidene chlorides, polyvinyl acetals, epoxys, silicones, vinyl chloride-vinyl acetate copolymers, polyvinyl alcohols, polyesters, polyvinyl butyrals, nitrocelluloses, ethyl celluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents, and combinations thereof. In embodiments, the binder component comprises a member selected from the group consisting of phenolic-formaldehyde resin, melamine-formaldehyde resin, urea-formaldehyde resin, benzoguanamine-formaldehyde resin, glycoluril-formaldehyde resin, acrylic resin, styrene acrylic copolymer, and mixtures thereof.

In embodiments, the undercoat layer may contain an optional light scattering particle. In various embodiments, the light scattering particle has a refractive index different from the binder and has a number average particle size greater than about 0.8 μm. In various embodiments, the light scattering particle is amorphous silica P-100 commercially available from Espirit Chemical Co. In various embodiments, the light scattering particle is present in an amount of about 0% to about 10% by weight of a total weight of the undercoat layer.

In embodiments, the undercoat layer may contain various colorants. In various embodiments, the undercoat layer may contain organic pigments and organic dyes, including, but not limited to, azo pigments, quinoline pigments,.perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the undercoat layer may include inorganic materials, such as amorphous silicon, amorphous selenium, tellurium, a selenium-tellurium alloy, cadmium sulfide, antimony sulfide, titanium oxide, tin oxide, Zinc oxide, and zinc sulfide, and combinations thereof.

In embodiments, the thickness of the undercoat layer may be from about 0.1 to 30 microns.

A photoconductive imaging member herein can comprise in embodiments in sequence of a supporting substrate, an undercoat layer, an adhesive layer, a charge generating layer and a charge transport layer. For example, the adhesive layer can comprise a polyester with, for example, an $M_w$ of about 70,000, and an $M_n$ of about 35,000.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments electrically inactive binders are comprised of polycarbonate resins with for example a molecular weight of from about 20,000 to about 100,000 and more specifically with a molecular weight $M_w$ of from about 50,000 to about 100,000. Examples of polycarbonates are poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyldiphenyl)carbonate (also referred to as bisphenol-C-polycarbonate) and the like. In embodiments, the charge transport layer, such as a hole transport layer, may have a thickness from about 10 to about 55 microns.

The charge transport layers can comprise in embodiments aryl amine molecules, and other known charge components. For example, a photoconductive imaging member disclosed herein may have charge transport aryl amines of the following formula:

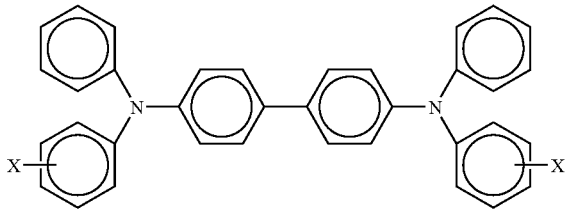

wherein x is alkyl, and wherein the aryl amine is dispersed in a resinous binder. In another embodiment, imaging member may have an aryl amine wherein x is methyl, a halogen that is chloride, and a resinous binder selected from the group consisting of polycarbonates and polystyrene. In yet another embodiment, the photoconductive imaging member has an aryl amine that is N,N'-diphenyl-N,N-bis(3-methylphenyl)-1,1'-biphenyl4,4'-diamine.

The charge transport aryl amines can also be of the following formula:

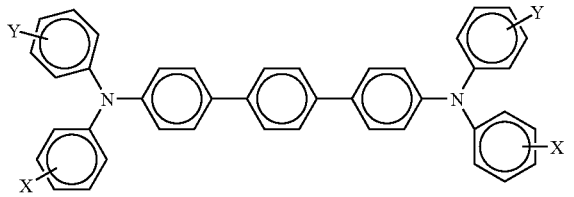

wherein X and Y are independently alkyl, alkoxy, aryl, a halogen, or mixtures thereof. Alkyl and alkoxy can contain for example from 1 to about 25 carbon atoms, and more specifically from 1 to about 12 carbon atoms, such as methyl, ethyl, propyl, butyl, pentyl, and the corresponding alkoxides.

Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl4,4'-diamine wherein alkyl is selected from the group consisting of methyl, ethyl, propyl, butyl, hexyl, and the like; N,N'-diphenyl-N,N'-bis (halophenyl)-1,1'-biphenyl4,4'-diamine wherein the halo substituent is a chloro substituent; N,N'-bis(4-butylphenyl)-N,N'-di-p-tolyl-[p-terphenyl]4,4"-diamine, N,N'-bis(4-butylphenyl)-N,N'-di-m-tolyl-[p-terphenyl]4,4"-diamine, N,N'-bis(4-butylphenyl)-N,N'-di-o-tolyl-[p-terphenyl]4,4"-diamine, N,N'-bis(4-butylphenyl)-N,N'-bis-(4-isopropylphenyl)-[p-terphenyl]4,4"-diamine, N,N'-bis(4-butylphenyl)-N,N'-bis-(2-ethyl-6-methylphenyl)-[p-terphenyl]4,4"-diamine, N,N'-bis(4-butylphenyl)-N,N'-bis-(2,5-dimethylphenyl)-[p-terphenyl]4,4"-diamine, N,N'-diphenyl-N,N'-bis(3-chlorophenyl)-[p-terphenyl]4,4"-diamine and the like and optionally mixtures thereof. Other known charge transport layer molecules can be selected, reference for example, U.S. Pat. Nos. 4,921,773 and 4,464,450, the disclosures of which are totally incorporated herein by reference. In embodiments, the charge transport layer may comprise aryl amine mixtures.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer or layers, and more specifically, a first charge transport in contact with the charge generating layer, and thereover a top or second charge transport overcoating layer may comprise the illustrated charge transporting small molecules dissolved or molecularly dispersed in a film forming electrically inert polymer such as a polycarbonate. In embodiments, dissolved refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale.

The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the charge transport layer to the charge generating layer can be maintained from about 2:1 to 200:1, and in some instances as great as 400:1. The charge transport layer is substantially nonabsorbing to visible light or radiation in the region of intended use, but is electrically "active" in that it allows the injection of photogenerated holes from the photoconductive layer, that is the charge generating layer, and allows these holes to be transported through itself to selectively discharge a surface charge on the surface of the active layer.

An adhesive layer may optionally be applied such as to the hole blocking layer. The adhesive layer may comprise any suitable material, for example, any suitable film forming polymer. Typical adhesive layer materials include for example, but are not limited to, copolyester resins, polyarylates, polyurethanes, blends of resins, and the like. Any suitable solvent may be selected in embodiments to form an adhesive layer coating solution. Typical solvents include, but are not limited to, for example, tetrahydrofuran, toluene, hexane, cyclohexane, cyclohexanone, methylene chloride, 1,1,2-trichloroethane, monochlorobenzene, and mixtures thereof, and the like.

In embodiments, a photoconductive imaging member further includes an adhesive layer of a polyester with an $M_w$ of about 75,000, and an $M_n$ of about 40,000.

The charge generating layer is comprised in embodiments of metal phthalocyanines, metal free phthalocyanines, rylenes, perylenes, hydroxygallium phthalocyanines, chlorogallium phthalocyanines, titanyl phthalocyanines, vanadyl phthalocyanines, selenium, selenium alloys, trigonal selenium, and the like, and mixtures thereof. In other embodiments, the charge generating layer is comprised of titanyl phthalocyanines, perylenes, or hydroxygallium phthalocyanines. In yet another embodiment, the charge generating layer is comprised of Type V hydroxygallium phthalocyanine.

The charge generating layer, which can be comprised of the components indicated herein, such as hydroxychlorogallium phthalocyanine, is in embodiments comprised of, for example,-about 50 weight percent of the hydroxygallium or other suitable photogenerating pigment, and about 50 weight percent of a resin binder like polystyrene/polyvinylpyridine. The charge generating layer can contain known photogenerating pigments, such as metal phthalocyanines, metal free phthalocyanines, hydroxygallium phthalocyanines, rylenes, perylenes, especially bis(benzimidazo)perylene, titanyl phthalocyanines, and the like, and more specifically, vanadyl phthalocyanines, Type V chlorohydroxygallium phthalocyanines, and inorganic components, such as selenium, especially trigonal selenium. The photogenerating pigment can be dispersed in a resin binder similar to the resin binders selected for the charge transport layer, or alternatively no resin binder is needed. Photogenerating pigments can be selected for the charge generating layer in embodiments for example of an amount of from about 10 percent by weight to about 95 percent by weight dispersed in a resinous binder.

Generally, the thickness of the charge generating layer depends on a number of factors, including the thicknesses of the other layers and the amount of photogenerator material contained in the charge generating layers. Accordingly, this layer can be of a thickness of, for example, from about 0.05 micron to about 15 microns, or from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The charge generating layer binder resin present in various suitable amounts, for example from about 1 to about 50 or from about 1 to about 10 weight percent, may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the charge generating layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Illustrative examples of polymeric binder materials that can be selected for the charge generating layer are as indicated herein, and include those polymers as disclosed in U.S. Pat. No. 3,121,006, the disclosure of which is totally incorporated herein by reference; phenolic resins as illustrated in the appropriate copending applications recited herein, the disclosures of which are totally incorporated herein by reference. In general, the effective amount of polymer binder that is utilized in the charge generating layer ranges from about 0 to about 95 percent by weight, or from about 25 to about 60 percent by weight of the charge generating layer.

In embodiments, the at least one charge transport layer comprises an antioxidant optionally comprised of, for example, a hindered phenol or a hindered amine.

Examples of binder materials for the transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes and epoxies, and block, random or alternating copolymers thereof. In embodiments, electrically inactive binders are selected comprised of polycarbonate resins having a molecular weight of from about 20,000 to about 100,000 or from about 50,000 to about 100,000. Generally, the transport layer contains from about 10 to about 75 percent by weight of the charge transport material or from about 35 percent to about 50 percent of this material.

In embodiments, the at least one charge transport layer comprises from about 1 to about 7 layers. For example, in embodiments, the at least one charge transport layer comprises a top charge transport layer and a bottom charge transport layer, wherein the bottom layer is situated between the charge generation layer and the top layer.

Also, included herein are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

Various exemplary embodiments encompassed herein include a method of imaging which includes generating an electrostatic latent image on an imaging member, developing a latent image, and transferring the developed electrostatic image to a suitable substrate.

In a selected embodiment, an image forming apparatus for forming images on a recording medium comprising: a) an imaging member having a charge retentive-surface for receiving an electrostatic latent image thereon, wherein the imaging member comprises a substrate, a charge generating layer disposed on the substrate, at least one charge transport layer disposed on the charge generating layer, and an anticurl back coating disposed on the substrate on a side opposite to the charge transport layer, the anticurl back coating comprising a polyol ester or polyol amide; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Comparative Example 1

A controlled anticurl back coating solution was prepared by introducing into an amber glass bottle in a weight ratio of 0.08:0.92 VITEL® 2200 (used to be VPE-200), a copolyester of iso/tere-phthalic acid, dimethylpropanediol and ethanediol having a melting point from about 302 to about 320° C., commercially available from Shell Oil Company, Houston, Tex., and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the substrate, a biaxially oriented polyethylene naphthalate substrate (KALEDEX® 2000) having a thickness of 3.5 mils, to form a coating of the anticurl back coating layer that upon drying (120° C. for 1 minute) had a thickness of 17.4 microns. During this coating process the humidity was equal to or less than 15 percent.

Example 1

A disclosed anticurl back coating solution was prepared by introducing into an amber glass bottle in a weight ratio of 0.02:0.0784:0.9016 HOSTASTAT™ FE20liq (glycerol fatty acid ester), available from Clariant Corporation, Charlotte, NC, VITEL® 2200 (used to be VPE-200), a copolyester of iso/tere-phthalic acid, dimethylpropanediol and ethanediol having a melting point from about 302 to about 320° C., commercially available from Shell Oil Company, Houston, Tex., and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the substrate, a biaxially oriented polyethylene naphthalate substrate (KALEDEX™ 2000) having a thickness of 3.5 mils, to form a coating of the anticurl back coating layer that upon drying (120° C. for 1 minute) had a thickness of 17.4 microns. During this coating process the humidity was equal to or less than 15 percent.

Example 2

A disclosed anticurl back coating dispersion was prepared by introducing into an amber glass bottle in a weight ratio of 0.02:0.09:0.0712:0.8188 HOSTASTAT™ FE20liq (glycerol fatty acid ester), available from Clariant Corporation, Charlotte, N.C., PTFE POLYFLON™ L-2 microparticle, commercially available from Daikin Industries, VITEL® 2200 (used to be VPE-200), a copolyester of iso/tere-phthalic acid, dimethylpropanediol and ethanediol having a melting point from about 302 to about 320° C., commercially available from Shell Oil Company, Houston, Tex., and MAKROLON® 5705, a known polycarbonate resin having a molecular weight average of from about 50,000 to about 100,000, commercially available from Farbenfabriken Bayer A.G. The resulting mixture was then dissolved and dispersed in methylene chloride via mechanical shear to form a dispersion containing 9.7 percent by weight solids. This dispersion was applied on the back of the substrate, a biaxially oriented polyethylene naphthalate substrate (KALEDEX™ 2000) having a thickness of 3.5 mils, to form a coating of the anticurl back coating layer that upon drying (120° C. for 1 minute) had a thickness of 18.7 microns. During this coating process the humidity was equal to or less than 15 percent.

Example 3

A disclosed anticurl back coating solution was prepared by introducing into an amber glass bottle in a weight ratio of 0.04:0.0768:0.8832 NINOL® C-5 (formerly AMIDOX® C-5, polyethylene glycol cocamide), available from STEPAN Company, Northfield, Ill., VITEL® 2200 (used to be VPE-200), a copolyester of iso/tere-phthalic acid, dimethylpropanediol and ethanediol having a melting point from about 302 to about 320° C., commercially available from Shell Oil Company, Houston, Tex., and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the substrate, a biaxially oriented polyethylene naphthalate substrate (KALEDEX™ 2000) having a thickness of 3.5 mils, to form a coating of the anticurl back coating layer that upon drying (120° C. for 1 minute) had a thickness of 17.4 microns. During this coating process the humidity was equal to or less than 15 percent.

Example 4

A disclosed anticurl back coating solution was prepared by introducing into an amber glass bottle in a weight ratio of 0.06:0.0752:0.8648 STEPAN™ PEG 400 DO (polyethylene glycol dioleate), available from STEPAN Company, Northfield, Ill., VITEL® 2200 (used to be VPE-200), a copolyester of iso/tere-phthalic acid, dimethylpropanediol and ethanediol having a melting point from about 302 to about 320° C., commercially available from Shell Oil Company, Houston, Tex., and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the substrate, a biaxially oriented polyethylene naphthalate substrate (KALEDEX™ 2000) having a thickness of 3.5 mils, to form a coating of the anticurl back coating layer that upon drying (120° C. for 1 minute) had a thickness of 17.4 microns. During this coating process the humidity was equal to or less than 15 percent.

Five photoreceptor devices were prepared with the above anticurl back coating solutions/dispersion, respectively to form an ACBC layer on the back side of the substrate. On the front side of the substrate, same-photoactive layers were prepared for all the examples as follows:

A 0.02 micron thick titanium layer was coated on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator, and which adhesive contains 0.2 percent by weight based on the total weight of the solution of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A charge generating layer dispersion was prepared by introducing 0.45 grams of the known polycarbonate LUPILON 200™ (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V)

and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a charge generating layer having a wet thickness of 0.25 mil. A strip about 10 millimeters wide along one edge of the substrate web bearing the blocking layer and the adhesive layer was deliberately left uncoated by any of the charge generating layer material to facilitate adequate electrical contact by the ground strip layer that was applied later. The charge generating layer was dried at 120° C. for 1 minute in a forced air oven to form a dry charge generating layer having a thickness of 0.4 microns.

The resulting imaging member web was then overcoated with a two-layer charge transport layer. Specifically, the charge generating layer was overcoated with a charge transport layer (the bottom layer) in contact with the charge generating layer. The bottom layer of the charge transport layer was prepared by introducing into an amber glass bottle in a weight ratio of 1:1 N,N'-diphenyl-N,N'-bis(3-methylphenyl)-1,1'-biphenyl4,4'-diamine, and MAKROLON 5705®, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the charge generating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process the humidity was equal to or less than 15 percent.

The above prepared photoreceptor devices were flat. The ACBC coatings for all the devices were defects free without any bubbles, which indicated excellent adhesions between the ACBC layer and the substrate. Incorporation of polyol ester or polyol amide into ACBC did not adversely affect coating quality of the layer and adhesion between the layer and the substrate.

The ACBC layers were tested for surface resistivity with a Hewlett Packard 4339A High Resistance Meter using a Hewlett Packard HP 16008B Resistivity Cell, 25 mm diameter electrode, 500 volt excitation, 5.0 Kilograms electrode pressure. The results are summarized in Table 1.

TABLE 1

| | Surface resistivity (ohm/cm$^2$) |
|---|---|
| Comparative Example 1 | $1.8 \times 10^{17}$ |
| Example 1 | $3.9 \times 10^{11}$ |
| Example 2 | $1.3 \times 10^{12}$ |
| Example 3 | $1.9 \times 10^{15}$ |
| Example 4 | $9.1 \times 10^{16}$ |

Incorporation of polyol ester or polyol armide into ACBC increased surface conductivity by from about 50 to about 1,000,000 times, which would help reduce or substantially eliminates, electrostatic charge buildup caused by friction with the backer plates and rollers. Incorporation of polyol ester or polyol amide into ACBC would also help reduce friction and improve wear resistance caused by contact with the backer plates and rollers.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An imaging member comprising:

a substrate;

a charge generating layer disposed on the substrate;

at least one charge transport layer disposed on the charge generating layer; and an anticurl back coating disposed on the substrate on a side opposite to the charge transport layer, the anticurl back coating comprising a polyol ester or a polyol amide and a copolyester comprising isophthalic acid and terephthalic acid, wherein the polyol amide is selected from the group consisting of condensates of fatty acid with diethanolamine, polyethylene glycol amide and mixtures thereof.

2. The imaging member of claim 1, wherein the polyol ester is generated from the reaction of a polyol containing at least one hydroxyl group and a monobasic acid or an acid halide.

3. The imaging member of claim 2, wherein the polyol ester is selected from the group comprised of trimethylpropane tricaprylate, pentaerythrityl tetracaprylate, neopentyl glycol caprylate caprate mixed ester, trimethyloipropane valerate heptanoate mixed ester, trimethyloipropane decanoate octanoate mixed ester, trimethylolpropane nananoate, pentaerythritol heptanoate caprate mixed ester, glycerol fatty acid ester, polyethylene glycol ester and butoxy ethyl stearate, and mixtures thereof.

4. The imaging member of claim 1, wherein the polyol amide is generated from the reaction of a polyamine containing at least one amine group and a monobasic acid or an acid halide.

5. The imaging member of claim 1, wherein the polyol ester or polyol amide is present in an amount of from about 0.1 percent to about 50 percent by weight of total weight of the anticurl back coating.

6. The imaging member of claim 5, wherein the polyol ester or polyol amide is present in an amount of from about 5 percent to about 40 percent by weight of total weight of the anticurl back coating.

7. The imaging member of claim 1, wherein the anticurl back coating has a thickness of from about 1 to about 100 microns.

8. The imaging member of claim 7, wherein the anticurl back coating has a thickness of from about 5 to about 50 microns.

9. The imaging member of claim 1, wherein the anticurl back coating further includes a material selected from the group consisting of polytetrafluoroethylene, silica, and mixtures thereof.

10. An imaging member, comprising:

a substrate;

a charge generating layer disposed on the substrate;

at least one charge transport layer disposed on the charge generating layer; and an anticurl back coating disposed on the substrate on a side opposite to the charge transport layer, the anticurl back coating comprising a polyol ester or a polyol amide and a copolyester comprising isophthalic acid and terephthalic acid, wherein the polyol ester is generated from the reaction of a polyol containing at least one hydroxyl group and a monobasic acid or an acid halide and the polyol amide is generated from the reaction of a polyamine containing at least one amine group and a monobasic acid or an acid halide, and further wherein the polyol amide is selected from the group consisting of condensates of fatty acid with diethanolamine, polyethylene glycol amide and mixtures thereof, and further.

11. An image forming apparatus for forming images on a recording medium comprising:

a) an imaging member having a charge retentive-surface for receiving an electrostatic latent image thereon, wherein the imaging member comprises a substrate, a charge generating layer disposed on the substrate, at least one charge transport layer disposed on the charge generating layer, and an anticurl back coating disposed on the substrate on a side opposite to the charge transport layer, the anticurl back coating comprising a polyol ester or a polyol amide and a copolyester comprising isophthalic acid and terephthalic acid, and further wherein the polyol amide is selected from the group consisting of condensates of fatty acid with diethanolamine, polyethylene glycol amide and mixtures thereof;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

12. The image forming apparatus of claim 11, wherein the polyol ester is generated from the reaction of a polyol containing at least one hydroxyl group and a monobasic acid or an acid halide.

13. The image forming apparatus of claim 12, wherein the polyol ester is selected from the group comprised of trimethylpropane tricaprylate, pentaerythrityl tetracaprylate, neopentyl glycol caprylate caprate mixed ester, trimethylolpropane valerate heptanoate mixed ester, trimethylolpropane decanoate octanoate mixed ester, trimethylolpropane nanoate, pentaerythritol heptanoate caprate mixed ester, glycerol fatty acid ester, polyethylene glycol ester and butoxy ethyl stearate, and mixtures thereof.

14. The image forming apparatus of claim 11, wherein the polyol amide is generated from the reaction of a polyamine containing at least one amine group and a monobasic acid or an acid halide.

15. The image forming apparatus of claim 11, wherein the polyol ester or polyol amide is present in an amount of from about 0.1 percent to about 50 percent by weight of total weight of the anticurl back coating.

16. The image forming apparatus of claim 15, wherein the polyol ester or polyol amide is present in an amount of from about 5 percent to about 40 percent by weight of total weight of the anticurl back coating.

17. The image forming apparatus of claim 11, wherein the anticurl back coating has a thickness of from about 1 to about 100 microns.

18. The image forming apparatus of claim 17, wherein the anticurl back coating has a thickness of from about 5 to about 50 microns.

* * * * *